United States Patent [19]

Chismar

[11] 4,134,089

[45] Jan. 9, 1979

[54] ELECTROMAGNET FOR AN EXTREMELY INVERSE TIME OVERCURRENT PROTECTIVE RELAY

[75] Inventor: Michael T. Chismar, Gloucester, N.J.

[73] Assignee: General Electric Company, Philadelphia, Pa.

[21] Appl. No.: 819,787

[22] Filed: Jul. 28, 1977

[51] Int. Cl.[2] ..... H01F 7/08

[52] U.S. Cl. ..... 335/225; 324/137

[58] Field of Search ..... 335/225, 243, 245; 324/137

[56] References Cited

U.S. PATENT DOCUMENTS

| | | | |
|---|---|---|---|
| 1,934,526 | 11/1933 | Deuser et al. | 335/225 X |
| 2,815,471 | 12/1957 | Braun | 335/225 |
| 2,872,626 | 2/1959 | Paddison | 335/225 |

FOREIGN PATENT DOCUMENTS

| | | | |
|---|---|---|---|
| 1265325 | 3/1972 | United Kingdom | 324/137 |

*Primary Examiner*—George Harris

*Attorney, Agent, or Firm*—William Freedman; Carl L. Silverman

[57] ABSTRACT

An electromagnet for use in an extremely inverse time overcurrent relay, wherein extremely inverse relay performance is obtained as a result of the electromagnet's simplified design. The electromagnet comprises a core having two E shaped portions of unequal size, each portion including a base wall, two outer legs and an inner leg, with the inner legs of the two portions being arranged in aligned opposition. The opposed and aligned inner legs of the core constitute magnetic pole members having opposed faces spaced apart and defining an air gap therebetween. Each pole member is provided with a shading ring shading the pole member by greater than 50%. Further, the electromagnet is provided with a single energizing means located on the core for establishing a flux distribution in the air gap whereby a rotatable armature which may be located in the air gap may be driven in response to an energizing current.

5 Claims, 4 Drawing Figures

ELECTROMAGNET FOR AN EXTREMELY INVERSE TIME OVERCURRENT PROTECTIVE RELAY

BACKGROUND

This invention relates to a protective time-overcurrent induction relay having extremely inverse time-overcurrent response characteristics, and more particularly, to an electromagnet for use therein.

In an electrical power transmission system, a general requirement is that the system provide electrical energy continuously. Unfortunately, however, from time to time fault conditions arise which if left unchecked would cause damage to not only system sections initially involved, but also to associated sections. Accordingly, it is common for various sections within a power transmission system to be interconnected by means of circuit breakers which may be activated in the event of a disturbance to disengage from the system sections undergoing fault.

The conventional apparatus used in the above described scheme for monitoring electrical parameters and for activating circuit breakers in the event fault conditions warrant is the protective relay. Typically, such a relay is arranged within the system to sense a circuit parameter, as for example current flow, and to initiate a command signal for the activation of appropriate circuit breakers when and if the monitored circuit parameter exceeds a predetermined condition.

A relay as described above which responds to excess current is known in the art as an overcurrent relay. Further, a particular variety of overcurrent relay is the so called induction type which, owing to its principles of operation, as will be more fully explained below, is used exclusively in alternating current applications.

In an overcurrent induction relay, the a.c. current to be monitored is used to energize an electromagnet, which in turn is employed to drive an armature which is adapted to actuate a set of contacts. If a sufficient current condition is presented to the electromagnet, as for example, a sensed sustained overcurrent, due perhaps to a short circuit, the electromagnet is energized so as to rotate the armature sufficiently to effectively actuate the contact set, whereby a command signal may be communicated to an appropriate circuit breaker.

In certain applications such as subtransmission lines and feeder circuits, overcurrent relaying is extensively used because of its low cost and simplicity. In these applications, the relay is often required not only to operate rapidly in response to fault conditions that give rise to currents well above maximum load current, but also not to operate in response to currents that exceed maximum load current for short intervals during normal circuit operation. In this regard, it is to be noted that current may exceed maximum load value for a short time during a normal reclosure sequence as the system is required to pick up cold loads following a previous interruption.

In such applications, it is therefore desirable for the relay operating time to be longer for lower values of excess current so that overcurrents occasioned during normal operation will not cause the relay to initiate an unnecessary circuit breaker command. Where excess overcurrent is high, as for example during a short circuit, it is desirable for the relay operating time to be short in order to limit circuit damage. Further, it is to be noted that time-overcurrent relays having operating times which vary inversely with respect to energizing current magnitude, can be divided into three classes. Included in the first class is the so called "inverse" time-overcurrent relay. Included in the second class is the so called "very-inverse" time-overcurrent relay which exhibit a shorter operating time for a given normalized energization level than relays of the first class. Included in the third class is the so called "extremely inverse" time-overcurrent relay, which exhibits an even shorter operating time than relays of the second class for the same normalized energization level. Further, standards for the performance of such relays have been defined and established in graphs of operating time versus activating quantity published by such groups as the IEEE. A particular example of this is the I.E.E.E. Standard for Relays and Relay Systems Associated with Electric Power Apparatus IEEE Std. 313 - 1971 (ANSI C37.90 - 1971).

A widely-accepted prior design of a time-overcurrent introduction relay electromagnet for providing an extremely-inverse performance characteristic includes a magnetic core structure having three magnetic poles and three associated pole faces arranged to define an air gap therebetween through which a rotatable armature may pass. In this prior design, the electrical circuit for the electromagnet includes a transformer having a primary winding and a secondary winding coupled to the magnetic core two separate inductors also coupled to the core, a fixed value capacitor, and a variable resistor.

By such an arrangement, a magnetic flux distribution in response to monitored circuit current can be established in the air gap between the magnetic pole faces to interact with the rotatable armature therein. As a result, when the electromagnet is energized, a torque is applied to the rotatable armature which is a function of monitored current. Further, by adjusting the values of capacitance, inductance and resistance in the circuit of the electromagnet, the functional relationship between operating time and magnitude of activating current for the relay, falls within the defined limits for extremely-inverse performance as established by the aforesaid I.E.E.E. Standard 313-1971.

Since the above described design requires a transformer, several individual inductors, a fixed capacitance and a variable resistance, it tends to be costly and complex to manufacture, large and bulky in size and subject to reduced reliability by virtue of the numerous components required.

SUMMARY

Accordingly, it is an object of the present invention to provide an electromagnet for use in an extremely-inverse time-overcurrent relay that is less costly and simpler to manufacture than the above-described prior design.

A further object of the present invention is to provide an electromagnet for use in an extremely-inverse relay that is small in size and which requires limited space for housing.

Yet a further objective of the present invention is to provide an electromagnet for use in an extremely-inverse relay of improved reliability by virtue of the reduced number of elements required for its operation.

Another object is to provide an electromagnet capable of providing extremely-inverse relay performance which includes a magnetic core having simply two magnetic poles, two associated magnetic pole faces arranged to define an air gap therebetween through which a rotatably armature may pass, and a single energizing coil.

In carrying out the invention in one form, I provide a magnetic core comprising two E-shaped portions located on opposite sides of a reference plane and facing each other in opposed relationship. Each E-shaped portion comprises a base wall and three spaced-apart legs (in the form of two outer legs and one inner leg) projecting laterally from said base wall. The free ends of the outer legs of the two E-shaped portions are joined together. Each of the inner legs constitutes a magnetic pole member, each with an associated pole face at its free end having a slot located therein which divides said pole member into two pole segments with associated pole faces. The pole members are arranged with their pole faces substantially aligned and spaced apart in opposition to each other to define an air gap between said pole faces adapted to receive a rotatable armature.

Located in each of the pole face slots and surrounding one of the associated pole segments, there is shading means for providing each pole member with a shaded pole segment. The shaded pole segment of each pole member has a larger pole face area than the unshaded segment of said pole member. Energizing means is arranged on the core for establishing magnetic flux in said core and through said air gap in response to a sensed circuit current.

BRIEF DESCRIPTION OF THE DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

DETAILED DESCRIPTION OF PREFERRED EMBODIMENT

Figure 1:
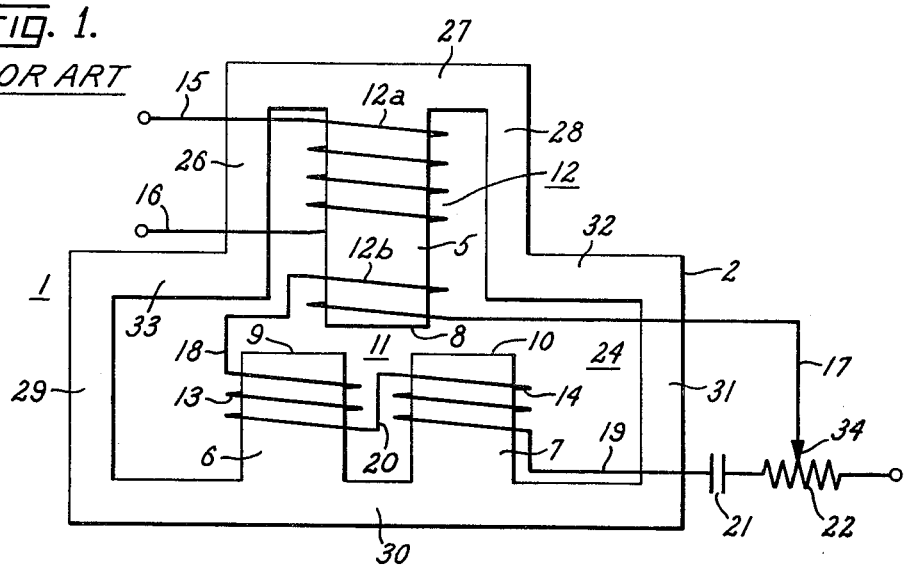
Fig. 1. PRIOR ART
FIG. 1 is a front elevational view, partly schematic, of an electromagnet used in a prior art extremely-inverse time-overcurrent induction relay.

Referring now to FIG. 1, the prior art electromagnet 1 shown therein comprises a magnetic core 2 having a plurality of laminations (not shown) located in planes parallel to the plane of the paper. The core is made of magnetic material such as silicon iron and comprises an upper generally-rectangular portion having walls 26, 27, 28 and a lower generally-rectangular portion having walls 29, 30, 31, 32, 33. Walls 32 and 33 of the lower portion are suitably joined to walls 28 and 26, respectively, of the upper portion. Bounded by these walls is an internal core cavity 24. Projecting downwardly from the upper wall 27 of the upper core portion into cavity 24 is a magnetic pole 5 having an associated magnetic pole face 8. Projecting upwardly into cavity 24 from lower segment wall 30 in opposition to downwardly-projecting pole 5 are two additional magnetic poles 6, 7 having respectively associated magnetic pole faces 9, 10. The three magnetic poles 5, 6, 7 and their respective associated pole faces 8, 9, 10 are arranged within core cavity 24 so as to define an air gap 11 between pole faces 9 and 10 on one hand and pole face 8 on the other hand.

Surrounding magnetic pole 5 are the windings of a transformer 12 of a well-known construction. The primary winding 12*a* of the transformer is connected between electrical leads 15 and 16, and the secondary winding 12*b* is connected between electrical leads 17 and 18. Additionally, the magnetic poles 6 and 7 are shown respectively surrounded by individual inductances in the form of coils 13 and 14. Finally, as shown in schematic form, completing the prior art electromagnet electric circuit is capacitor 21 and variable resistor 22.

The inductors 13 and 14, the capacitor 21 and the variable resistor 22 are connected in series with each other by means of conductors 19 and 20, and this series combination is connected across the transformer secondary winding 12*b* by leads 17 and 18.

By virtue of the above design, it is possible to establish a magnetic flux distribution in air gap 11 for interaction with a rotatably armature disposed therein (not shown) which results in extremely-inverse relay performance in response to an energizing current.

As explained above, an object of the present invention is to provide an electromagnet which provides for extremely-inverse relay performance but which possesses a lower number of elements, smaller physical size and increased simplicity as compared with the design described above.

Figure 2:
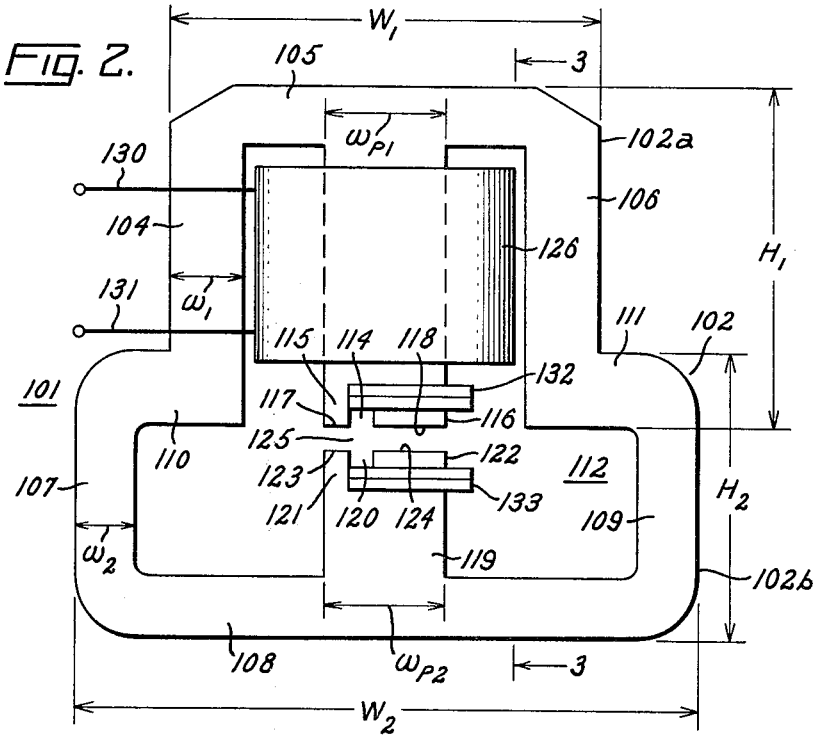
FIG. 2 is a front elevational view, partly schematic, of an electromagnet embodying one form of the present invention for use in an extremely-inverse time-overcurrent relay.
Figure 3:
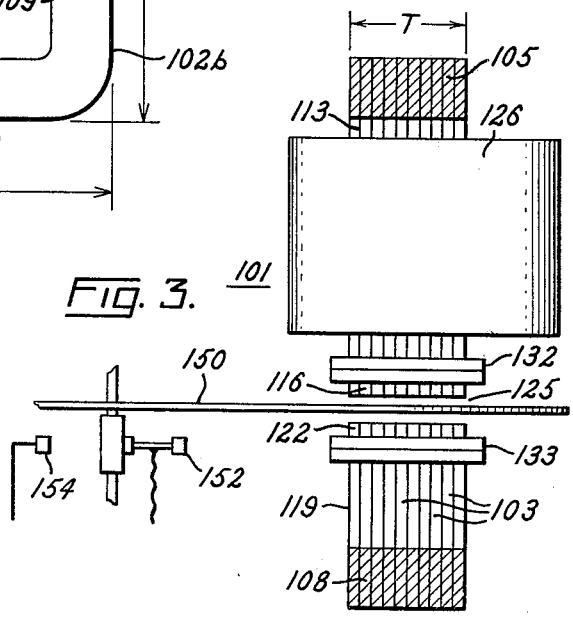
FIG. 3 is a sectional view taken along the line 3—3 of FIG. 2 and further including additional parts of the relay.

In accordance with the present invention, an electromagnet of such design is illustrated at 101 in FIG. 2. This electromagnet comprises a magnetic core 102 of predetermined dimensions having a plurality of laminations 103, seen in FIG. 3, disposed in planes parallel to the plane of FIG. 2. These laminations are of magnetic material such as silicion iron. Additionally, core 102 is seen to comprise an upper generally E shaped portion 102*a* having walls 104, 105, 106 and a lower generally E shaped portion 102*b* having walls 107, 108, 109, 110 and 111. Walls 110 and 111 of the lower portion are suitably joined to the walls 104 and 106, respectively, of the upper portion. Bounded by these walls is an internal core cavity 112. Preferably, the upper core portion 102*a* is located centrally of lower core portion 102*b*. Further, the upper and lower core portions 102*a, b* respectively are of different size, upper section 102*a* being of less width W than lower section 102*b*, but of greater height H.

Projecting downwardly a predetermined distance from and centrally of the upper wall 105 of the upper portion into cavity 112 is a first magnetic pole 113 of a predetermined width $w_p$ and of a thickness T equal to that of core 102, having a slot 114 therein located at the pole face.

Slot 114 divides at least a portion of pole 113 into two poles segments 115 and 116 having associated pole faces 117 and 118 respectively. The relative size of the pole segments 115 and 116 and the associated pole faces 117 and 118 are important determinants of the response characteristic of the magnet, as will soon be described.

Projecting upwardly a predetermined distance from and centrally of lower wall 108 into cavity 112 in alignment opposition with pole 113 is a second magnetic pole 119 of a predetermined width shown equal to that of the other pole 117 of a thickness equal to that of core 102, and having a slot 120 located therein at the pole face. The slot 120 divides at least a portion of pole 119 into two pole segments 121 and 122 having associated pole faces 123 and 124 respectively. The relative size of pole segments 121 and 122 and associated pole faces 123 and 124 are also important determinants of the response characteristics of the electromagnet as will soon be described.

The core arrangement as above described may be thought of as comprising two E-shaped portions located on opposite sides of a horizontal reference plane and facing each other in opposed relationship. The upper E-shaped portion may be thought of as comprising a base wall (105) and three spaced-apart legs (104,116, and 106) projecting laterally therefrom. The lower portion may similarly be thought of as comprising a base wall (108) and three spaced-apart legs (107, 119, and 109) projecting laterally therefrom. The free ends of the outer legs 104 and 107 of the two E-shaped portions are joined together through wall 110, and the free ends of outer legs 106 and 109 of the two E-shaped portions are joined together through wall 111. The inner legs 113 and 119 (i.e., the pole members) are located in aligned relationship and between their pole faces is air gap 125 which is adapted to receive a rotatable armature 150 of the relay. It has been found that among the features contributing to the extremely-inverse time-overcurrent relay performance that I am seeking is the particular form of the core disclosed.

Surrounding a portion of pole 113 is an energizing coil 126 having a multiplicity of turns in overlapping turn layers, insulated layer from layer by suitable insulation. Preferable the turns of the coil are formed of aluminum foil of conventioanl construction.

Coil 126 is itself insulated, as is well known in the art. Further, coil 126 is connectible to external circuit elements by electrical leads 130, 131.

Within slots 114 and 120 and surrounding pole segments 116 and 122, respectively, are shading ring 132 and 133, respectively. In addition to the core shape above noted, it has also been found that among the features contributing to the extremely-inverse time-overcurrent relay performance that I am seeking is the feature that the pole segment surrounded by the shading ring (i.e., the shaded segment) is larger than the unshaded pole segment. segment. In one specific form of the invention, 75 percent of each pole face is constituted by the face of a shaded segment. The shading rings are preferably made to fit pole segments 116 and 122 snugly or are fastened thereto by convenient fastening means (not shown) to prevent movement thereof within the slots. It is also to be realized that the number of shading rings in each slot is a design consideration and may vary depending on the performance desired. The ring themselves are made of a conductive material such as copper.

As explained above for protective relay operations, current sensed in the circuit to be protected is used to energize the relay electromagnet. Accordingly, as suggested by FIG. 3 when an excess circuit current is sensed, relay electromagnet 101 is energized so as to drive rotatable armature 150 sufficiently to close contacts 154, 152 and communicate a command signal to an appropriate circuit breaker for isolating the system section undergoing fault.

In accordance with the present invention, sensed circuit current is used to establish a magnetic flux distribution in magnetic core 102 and through gap 125. As stated previously, induction relays are employed in alternating current applications by reasons of their principles of operation. In this regard, it is noted that in an alternating current application, the magnitude of the instantaneous current will vary in time, accordingly, so also will the magnitude of magnetic flux in the electromagnet core vary in time.

As described earlier magnetic poles 113 and 119 are each split into unshaded segments 115, 121 and shaded segments 116 and 122 respectively. As a result, the time-varying flux therein is likewise split into an unshaded and a shaded component $\phi_1$ and $\phi_2$ respectively.

It is to be noted that the shading rings 132, 133 surrounding the shaded portions 116 and 122 of pole 113 and 119 respectively function as shortcircuited transformer secondaries. Therefore, the current induced in the shading rings by the action of the shaded flux component $\phi_2$ gives rise to a magnetomotive force which opposes the magnetomotive force of $\phi_2$ which served to establish it. This action gives rise to a time delay in the build-up of the shaded flux component $\phi_2$ in the shaded portion of the poles 116 and 122. Therefore, as the flux follows the a.c. variations of the sensed current, the flux component $\phi_1$ in the unshaded portion of the poles 115,121 reach a maximum in advance of the maximum reached in the shaded portion of the poles 116, 122. This action thereby establishes a phase shift between the unshaded and shaded flux components $\phi_1$ and $\phi_2$ respectively.

Since the rotatable armature 150 (FIG. 3) passes through air gap 125 its major surface is orthagonal to and pierced by the two out-of-phase a.c. flux components, $\phi_1$ and $\phi_2$. As a result, each flux component induces a voltage and an associated eddy current in the armature. Further, each flux component reacts with the eddy current produced by the other flux component to produce two forces on the armature the sum of which is a steady unidirectional force. By virtue of this action, a force is established from the point where the leading flux pierces the armature toward the point where the lagging flux pierces the armature which results in a torque acting on the armature with the same sense. Thus, it is as though the flux is moved across the armature dragging the armature along. It is further to be noted that the torque which is applied to the armature is a function of the flux produced in the core and the phase angle between the flux components of the shaded and unshaded pole.

From the above discussion, it should therefore be appreciated that since torque is determined by core design and pole shading and since applied torque primarily determines the rate at which the armature is advanced, then the rate at which the armature is advanced in response to sensed circuit current, that is to say the relay operating characteristic, is determined by the particular combination of core design and shading employed. From the preceding it can readily be seen that such action requires time varying quantities and this explains why such electromagnets are used exclusively in a.c. applications.

By employing a double-E core configuration and generally aligned magnetic poles having larger cross-sectional areas shaded than unshaded, I have been able to drive the armature at a rate which provides the extremely-inverse time-overcurrent characteristics that I am seeking.

Figure 4:
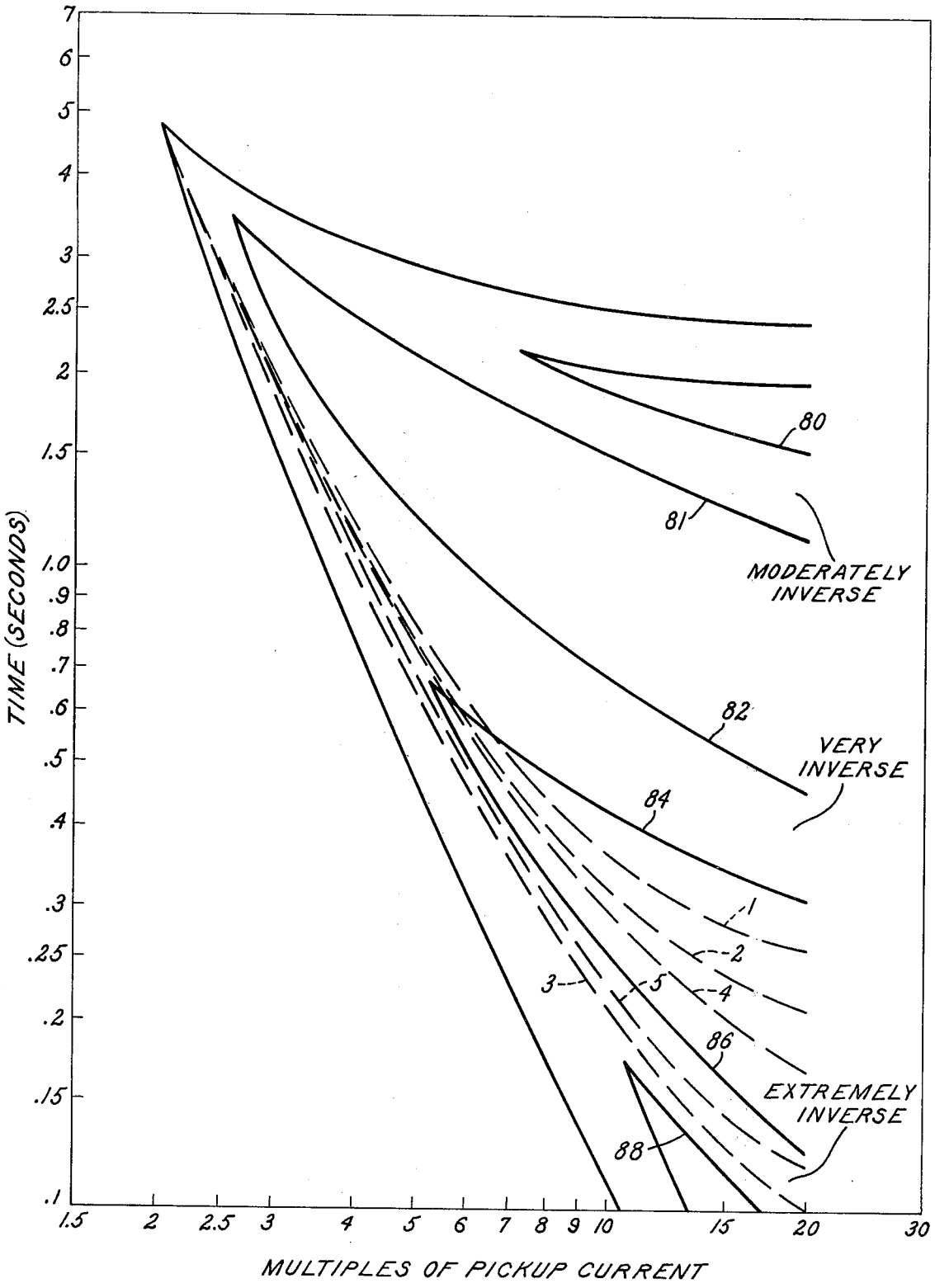
FIG. 4 is a graphic representation of the performance characteristics for various relays utilizing differing electromagnets in accordance with the present invention, plotted with respect to the aforesaid I.E.E.E. Standard 313-1971.

With regard to FIG. 4, and the I.E.E.E. Standard 313-1971 referred to above, it is to be noted that response characteristic curves falling between the curves 80 and 81 are defined as a moderately inverse time-overcurrent response while response characteristic curves falling between curves 82 and 84 are defined as a very inverse time-overcurrent responses; with response characteristic curves falling between curves 86 and 88 being defined as extremely-inverse time-overcurrent responses. It will be seen from FIG. 4 that my characteristic curves for examples 3 and 5 fall within the extremely-inverse band of responses.

While those skilled in the art will realize that although many combinations of core design and degree of shading are possible only certain combinations provide the desired results. The following illustrative but not limiting examples of the novel arrangements herein described are provided to further inform those skilled in the art of the nature and utility of the features according to the present invention while further explaining the effects of their variation on device performance.

Accordingly, presented in Table 1 are descriptions of particular electromagnet structures having unsymmetrical opposed double E shaped cores with shaded poles in accordance with the present invention. Unless otherwise indicated, all dimensions are in inches.

TABLE 1

ELECTROMAGNETIC CONFIGURATION

| Core Parameters | Examples 1 | 2 | 3 | 4 | 5 |
|---|---|---|---|---|---|
| Upper "E" Segment | | | | | |
| Height $H_1$ | 2.24 | 2.24 | 2.24 | 2.24 | 2.24 |
| Width $W_1$ | 2.81 | 2.81 | 2.81 | 2.81 | 2.81 |
| Side Wall Width $w_1$ | 0.47 | 0.47 | 0.47 | 0.47 | 0.47 |
| Thickness T | 0.50 | 0.75 | 0.75 | 0.625 | 0.75 |
| Pole Width $w_{p1}$ | 0.75 | 0.75 | 0.75 | 0.75 | 0.75 |
| Percentage Shading | 50% | 50% | 75% | 50% | 75% |
| * Number of Shading Rings | 4 | 4 | 3 | 3 | 3 |
| Lower Segment | | | | | |
| Height $H_2$ | 1.82 | 1.82 | 1.82 | 1.82 | 1.82 |
| Width $W_2$ | 4.04 | 4.04 | 4.04 | 4.04 | 4.04 |
| Side Wall Width $w_2$ | 0.20 | 0.20 | 0.376 | 0.376 | 0.376 |
| Thickness T | 0.50 | 0.75 | 0.75 | 0.625 | 0.75 |
| Pole Width $w_{p2}$ | 0.75 | 0.75 | 0.75 | 0.75 | 0.75 |
| Percentage Shading | 50% | 50% | 75% | 50% | 75% |
| * Number of Shading Rings | 4 | 4 | 3 | 3 | 3 |
| Gap Width | 0.11 | 0.11 | 0.10 | 0.084 | 0.07 |

* Each Shading Ring 1/16" thick

Correspondingly, Table 2 presents a summary of relay performance obtained with electromagnet structures described in Table 1. The performance obtained has been characterized in terms of time, in seconds, to relay contact closure in response to multiples of pick up current, where multiples of pick up current is a representation of excitation level normalized to the current level at which the relay armature rotation is first noted. For this evaluation relay contacts were arranged in combination with an aluminum armature.

A better appreciation for the relative performance of the examples listed in Table 2 may be had with reference to FIG. 4, where the performance for the examples presented are plotted in dot dash lines relative to IEEE Standard 313-1971 above referred to.

TABLE 2

PERFORMANCE

| Multiples of Pick Up Current | Time in Seconds to Contact Closure Examples 1 | 2 | 3 | 4 | 5 |
|---|---|---|---|---|---|
| 2 | 4.80 | 4.80 | 4.80 | 4.80 | 4.80 |
| 3 | 1.95 | 1.92 | 1.82 | 1.93 | 1.97 |
| 5 | 0.78 | 0.77 | 0.64 | 0.74 | 0.71 |
| 7 | 0.52 | 0.50 | 0.35 | 0.46 | 0.39 |
| 10 | 0.36 | 0.32 | 0.21 | 0.29 | 0.23 |
| 20 | 0.26 | 0.21 | 0.10 | 0.17 | 0.12 |

Finally, it should be apparent to those skilled in the art, that while I have shown and described what at present are considered to be preferred embodiments of my invention changes may be made in the structure and method disclosed without departing from the actual and true spirit and scope of this invention.

What I claim as new and desire to secure by Letters Patent is:

1. An electromagnet for an extremely-inverse time-overcurrent relay comprising:

(a) a magnetic core comprising two E-shaped portions, each portion comprising a base wall and two outer legs and an inner leg projecting laterally from said base wall in spaced-apart relationship, and means joining together the free ends of the outer legs of said two E-shaped portions so that said E-shaped portions face each other in opposed relationship, (b) each of said inner legs constituting a magnetic pole member, each with an associated pole face at its free end having a slot located therein which divides said pole member into two pole segments with associated pole faces, said pole members being arranged with their pole faces spaced apart, generally aligned, and in opposition to each other to define an air gap between said pole faces adapted to receive a rotatable armature therein;

(c) shading means located in each of said pole face slots and surrounding one of said associated pole segments for providing each said pole member with a shaded pole segment; the shaded pole segment of each pole member having a larger pole face area than the unshaded segment of said pole member, and (d) energizing means arranged on said core for establishing magnetic flux in said core and through said air gap in response to a sensed circuit current.

2. An electromagnet as defined in claim 1 wherein a different spacing is present between the outer legs of the two E-shaped portions, thereby rendering said core asymmetrical with respect to a plane located between the two E-shpaed portions.

3. The electromagnet of claim 1 wherein said shading means comprises at least one ring-like member made of a conductive material located in each said pole face slot and surrounding each said shaded pole segment.

4. The electromagnet of claim 1 wherein said energizing means is a single coil located on one of said magnetic pole members.

5. An extremely-inverse time-overcurrent protective relay comprising:

(a) a set of contacts, (b) a rotatable armature for effectively actuating said contacts upon a predetermined amount of rotation, (c) an electromagnet constructed as defined in claim 1, (d) said armature being located so that a portion thereof passes through said air gap of said electromagnet, the flux in said air gap interacting with said armature to produce rotation thereof for effectively actuating said contacts.

* * * * *